United States Patent [19]

Miller

[11] 4,327,800

[45] May 4, 1982

[54] METHOD OF MANUFACTURING HEAT EXCHANGER CORE AND ASSEMBLY THEREFOR

[75] Inventor: Kenneth J. Miller, Peoria, Ill.

[73] Assignee: Caterpillar Tractor Co., Peoria, Ill.

[21] Appl. No.: 99,139

[22] PCT Filed: Sep. 24, 1979

[86] PCT No.: PCT/US79/00765

§ 371 Date: Sep. 24, 1979

§ 102(e) Date: Sep. 24, 1979

[51] Int. Cl.[3] ..... F28F 13/12; B23P 15/26

[52] U.S. Cl. ..... 165/79; 29/157.3 B; 29/157.3 C; 228/177; 228/183; 165/151; 165/182

[58] Field of Search ..... 29/157.3 A, 157.3 B, 29/157.3 C; 113/118 A, 118 B, 118 C, 118 D, 118 V; 165/182, 79, 151; 228/177, 183

[56] References Cited

U.S. PATENT DOCUMENTS

| | | | |
|---|---|---|---|
| 1,048,107 | 12/1912 | Stolp . | |
| 1,850,473 | 3/1932 | Owston | 29/157.3 B |
| 1,865,051 | 6/1932 | Trane | 29/157.3 A |
| 2,064,036 | 12/1936 | Sandberg | 29/157.3 B |
| 2,232,562 | 2/1941 | Sandberg | 113/118 B |
| 2,252,210 | 8/1941 | Seemiller | 113/118 B |
| 2,267,315 | 12/1941 | Stikeleather | 29/157.3 B |
| 2,278,155 | 3/1942 | Steenstrup | 113/118 B |
| 2,414,159 | 1/1947 | Modine | 113/118 D |
| 4,041,594 | 8/1977 | Chartet | 29/157.3 C |

FOREIGN PATENT DOCUMENTS

| | | | |
|---|---|---|---|
| 211632 | 7/1957 | Australia | 29/157.4 |
| 435501 | 10/1926 | Fed. Rep. of Germany | 113/118 B |
| 515391 | 12/1939 | United Kingdom | 113/118 A |

*Primary Examiner*—Francis S. Husar
*Assistant Examiner*—V. K. Rising
*Attorney, Agent, or Firm*—Phillips, Moore, Weissenberger, Lempio & Majestic

[57] ABSTRACT

Prior art exchanger cores (10) have been expensive to produce and have too often had poorly heat conductive joining of the liquid circulating tubes (12) to the cooling fins (14). Herein, the tube (12) is fitted into holes (28) in the fins (14) with a small gap (42 or 44) between a portion (20,22) of the tube (12) and the hole (28). Solder sources (38) e.g., sheets (38) having holes (40) therethrough which generally match the holes (28) in the fins (14), are positioned between some of the fins (14) with the tubes (12) fitting in the holes (40) in the solder sheets (38). The entire assembly (50) is heated with the tubes (12) being held generally vertically. As the solder sheets (38) melt, solder flows through the gap (42 or 44) wetting not only the fin (14) above which it sits, but also lower fins (14). Capillary action leads to solder wetting the entire junction between each fin (14) and each tube (12). Good solder joints having excellent heat conducting properties are produced.

14 Claims, 3 Drawing Figures

METHOD OF MANUFACTURING HEAT EXCHANGER CORE AND ASSEMBLY THEREFOR

DESCRIPTION

Technical Field

This invention relates to a method for soldering heat exchanger cores and to an assembly which is formed into a heat exchanger core in a single step heating operation.

Background Art

Heat exchanger cores, such as radiator cores, are formed of one or more tubes having a plurality of fins, usually orthogonally connected to them. A liquid coolant generally flows through the tubes. Air is generally flowed over the fins. When there is good heat conductive contact between the fins and the tubes, the temperature of the liquid flowing through the tubes can be controlled.

The tubes and fins of such radiator cores as have just been described, are conventionally connected together by solder.

Prior art methods of accomplishing the soldering of the tubes to the fins has not been wholly satisfactory in terms of joint quality and in terms of cost effectiveness.

The conventional prior art methods of forming radiator cores includes pretinning both the tubes and fins with solder, positioning the fins in a jig, inserting the tubes into appropriate holes in the fins and then immersing the assembly in an appropriate flux, for example, an acid flux.

In one prior art method, the assembly is simply heated in an oven with the soldering taking place due to the pretinning of both the tubes and the fins. Unfortunately, this leads to relatively poor bonding between the tubes and the fins with resultant bad heat transfer properties for the radiator. Visual inspection of the core may reveal some of the poor bonds in which case they can be repaired by hand. However, such repair is relatively time consuming and, hence, greatly raises the overall cost of the resultant radiator. Still further, headers (which resemble somewhat thicker fins) are generally attached at the ends of the tubes in the same operation as the fins are attached. The headers carry the structure and attach it to the top and bottom liquid containing tanks. Leaks at headers are clearly highly undesirable since the liquid in the system can escape therefrom. Such leaks can be tested for by pressuring the tanks, but this again adds a time consuming and expensive step to the production of a satisfactory radiator core.

In a second prior art method the assembly, after its immersion in flux, is dipped in a molten solder bath after first plugging the ends of the tubes. The assembly is removed from the bath, shaken, and the excess solder is blown off while the radiator core remains hot. This method gives satisfactory solder joints, but is wasteful of solder to some extent and thereby increases cost. Further, the temporary plugging of the tube ends increases the expense of the overall radiator.

A third prior art method comprises a variation on the first prior art method. The assembly, after immersion in the flux, is positioned with the tubes horizontal and the fins vertical. Strips of solder are placed on the sharp thin edges of the fins just over the positions where the tubes pass therethrough. The entire assembly is then heated in an oven while the tubes are maintained horizontal and the fins are maintained vertical. The solder then flows from the fin edges to the tubes. This leads to an improvement in the number of good solder joints obtained as compared to the first method, but it is only partially successful due to the distance from the fin edges to the tube. That is, not all of the solder joints obtained are satisfactory when one operates by this third method. Thus, visual inspection is still necessary along with some hand repair. Further, leaks at the headers must be tested for as in the first method, thus leading to increased time in producing the cores and resulting increased costs.

A method of making heat exchanger cores which suffers from none of the problems of the prior art methods would clearly be highly desirable.

Disclosure of Invention

According to one aspect of the present invention, a method is provided of forming a structure having at least one tube which has a first pair of opposite sides and a second pair of opposite sides connecting together the first pair of opposite sides and having a plurality of fins having holes in which the tube fits and is soldered. The holes have a first pair of opposite edges connected together by a second pair of opposite edges. The method comprises fitting the tube in the holes with a gap between at least one of the first pair of sides and one of the first pair of opposite edges associated with one of the first pair of sides, the second pair of opposite sides abutting against the second pair of opposite edges, positioning a source of solder having a generally matching hole to those in the fins above an upper one of a selected pair of adjacent fins, a space intermediate the selected pair of adjacent fins being free of any solder source, aligning the tube with the solder sources generally vertically above the fins to form a precore assembly, and heating the aligned assembly sufficiently to liquify the solder source and form a solder connection of the tube to at least a selected pair of fins below the source at the holes, the solder source when liquified flowing through and filling the gap and hardening in the gap to form solder connections.

In another aspect of the present invention, an assembly is disclosed which is formably into a radiator core via bulk heating treatment thereof. The assembly comprises a plurality of tubes, each tube having a first pair of opposite sides and a second pair of opposite sides connecting together the first pair of opposite sides. Also part of the assembly are a plurality of generally parallel fins, each fin having a plurality of holes, having a first pair of opposite edges and a second pair of opposite edges connecting together the first pair of opposite edges. The fins are mounted at the holes generally orthogonal to the tubes with a gap between at least one of the first pair of sides and one of the first pair of edges. The second pair of opposite sides abuts against the second pair of opposite edges. Also part of the assembly are a plurality of sources of solder, each source of solder having a plurality of holes generally matching the holes in the fins. The sources of solder are mounted at the matching holes to the tubes between the fins, at least two fins are disposed intermediate each of the sources of solder.

With such an assembly and method, excellent solder joints are obtained which have good heat transfer properties. The amount of solder utilized is minimal. Further, it is not even necessary to pre-tin either the tubes or the fins, although preferably the tubes are pre-tinned.

BEST MODE FOR CARRYING OUT THE INVENTION

Figure 1:
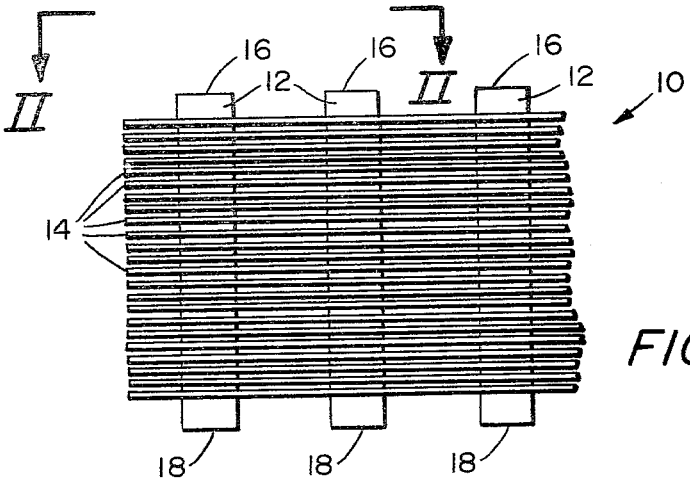
FIG. 1 is a fragmentary view in front elevation of a completed heat exchanger core.

FIG. 1 shows a heat exchanger core 10 having a plurality of tubes 12 generally orthogonally connected to a plurality of generally parallel fins 14. The tubes 12 generally have a top end 16 and a bottom end 18 and are often used in vertical alignment as illustrated in FIG. 1.

Figure 2:
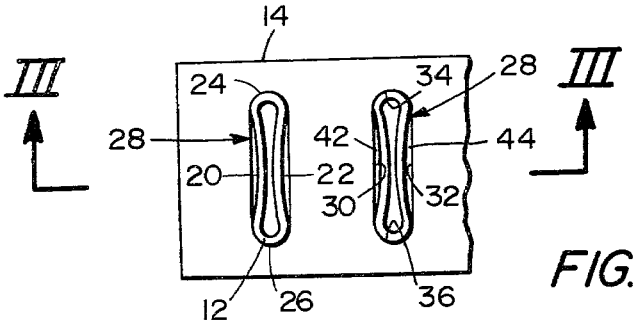
FIG. 2 is a fragmentary top view along line II-II of FIG. 1, but showing the heat exchanger core assembly prior to completion of the soldering step in the manufacture thereof.
Figure 3:
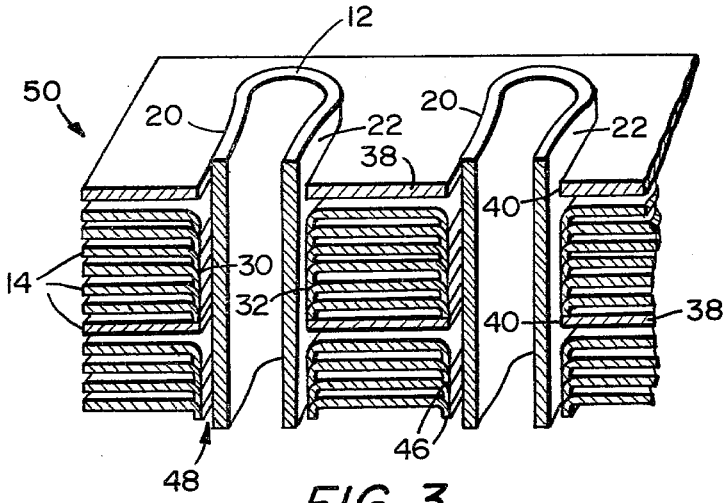
FIG. 3 is an enlarged perspective view, partially in section, taken along line III-III of FIG. 2.

Adverting now to FIGS. 2 and 3, it will be seen that the tubes 12 have a first pair of opposite sides 20 and 22 and a second pair of opposite sides 24 and 26, with the second pair of opposite sides 24 and 26 connecting together the adjacent edges of the first sides 20 and 22.

The fins 14 each have a plurality of holes 28 which have a first pair of opposite edges 30 and 32 and a second pair of opposite edges 34 and 36 which connect the adjacent ends of the first pair of edges 30 and 32.

Reference particularly to FIG. 3 will show a plurality of sources of solder, in particular a plurality of foils or sheets 38 of solder. Each of the sheets 38 of solder has a plurality of holes 40 which generally match the holes 28 in the fins 14. The sheets 38 are mounted at their holes 40 to the tubes 12 intermediate some adjacent fins 14.

It will be noted that there is a gap 42 between the side 20 of the tube 12 and the edge 30 of the hole 28. There is also a gap 44 between the side 22 of the tube 12 and the edge 32 of the hole 28. The gaps 42 and 44 are exaggerated in size in FIGS. 2 and 3. These gaps 42 and 44 are important for reasons which will be set out in following. Also, by reference to FIG. 3, it will be seen that portions of the fins 14, at the edges 30 and 32 of the holes 28, are bent towards one end, namely the lower end 18, of the tube 12. The bent portions of the fins 14 are disignated by the numeral 46. The various bent portions 46 of the fins 14 form funnels 48 as seen best in FIG. 3. Each funnel 48 may be positioned to contact the adjacent funnel 48 to determine the spacing between adjacent of the fins 14.

Method

In accordance with an embodiment of the method of the present invention, a structure, generally a heat exchanger core 10, is formed by fitting at least one tube 12 in the holes 28 in the fins 14 with gaps 42 and 44 between the sides 20 and 22 of the tube 12 and the adjacent edges 30 and 32 of the holes 28. A solder source, generally the sheets 38 which have a generally matching hole 40 to the holes 28 in the fins 14, is positioned adjacent one of the fins 14 with the matching hole 40 about the tube 12. The tube 12 is aligned with the sheet 38 generally vertically above the fins 14 to form a precore assembly 50 shown best in partial view in FIG. 3. The aligned assembly 50 is heated sufficiently to liquify the solder sheet 38 and form a solder connection of the tube 12 to more than one of the fins 14 located below the solder sheet 38, the connection being at the edges 30, 32, 34, 36 of the hole 28.

The method of the present invention will preferably include bending a portion of the fins 14 at the edges 30 and 32 of the holes 28 towards the bottom end 18 of the tube 12. This serves to provide the funnels 48 previously mentioned. With such an arrangement, the sheets 38 can be placed a considerable number of fins 14 apart, and even with a high fin count, for example, 10 fins per centimeter and with the sheets 38 about 25 centimeters apart, excellent solder joints are prepared, even in the absence of tinning of either the tubes 12 or the fins 14. Basically, the solder, when it melts, flows through the gaps 42 and 44 while at the same time flowing around the entire periphery defined by the hole 28 and the tube 12 due to capillary action.

According to the preferred embodiment of the invention, the first pair of sides 20,22 of the tubes 12 are bent inwardly so that the tubes 12 have an hourglass shape in cross section. It is preferred that, in the absence of any stress on the tube 12, the holes 28 be formed with a slightly smaller dimension between the second pair of edges 34 and 36 thereof than the dimension of the tubes 12 measured between the exterior surface of the pair of second sides 24 and 26 of the tube 12, and that the holes 28 have substantially the same dimension between the first pair of edges 30 and 32 as the dimension of the tubes 12 measured between the exterior surfaces of the pair of sides 20 and 22. The tubes 12 are then force fit into the holes 28, whereby the first pair of sides 20 and 22 bulge inwardly, as is seen most clearly in FIG. 2, to leave the gaps 42 and 44.

The dimension of the hole 28 between the edges 34 and 36 thereof is generally from about 0.2% to about 1% short of the corresponding dimension of the tube 12 in its undistorted state. This assures that the gaps 42 and 44 are of a proper size.

It is preferred that the bending step which forms the funnel 48 be performed prior to the fitting of the tubes 12 into the holes 28. A very suitable way for performing the bending step is by simply stamping or punching the holes 28 into the fins 14. Further, when the tubes 12 are fitted into the holes 28 they are inserted in the direction of the bending.

Generally, the assembly 50 is sprayed with flux, for example, acid flux, prior to its being placed in a furnace. This has been found to give good results and to waste less flux than the prior art method of dipping into a bath of flux. Particularly good results have been obtained with a furnace temperature of approximately 315° C. The assembly 50 is normally held in the furnace until it attains a temperature of approximately 270° C., it is then held for 5 minutes at that temperature, removed from the furnace and steam blasted to remove any flux residue. The core is normally painted at the end of the operation to protect it, particularly the fins, from corrosion. The use of 70% lead-30% tin solder with an acid flux has produced excellent heat exhanger cores 10. While the tubes 12 and fins 14 can be of any desired material having the necessary properties for a heat exchanger core, generally the tubes will be made of brass and the fins of steel, copper or brass.

It should be noted that the fitting of the tube 12 in the holes 28 will generally take place by fastening the tubes 12 in place in a jig and then forcing the fins 14 over the tubes 12 with the bent edges 46 properly aimed in the direction opposite to the direction of movement of the fins 14 so that the tubes 12 do not damage them and so that any tinning on the tubes 12 is not damaged. The solder sheets 38 are occasionally alternated at desired intervals between fins 14.

Industrial Applicability

The present invention is particularly useful for making heat exchanger cores, and more particularly radiator cores, for providing cooling for engines, such as vehicle engines. A very reliable soldering method is provided which gives good soldered joints having good heat transfer characteristics. Leaks at headers are virtually eliminated, even if the tubes 12 and/or the fins 14 are not pre-tinned. The amount of solder utilized is relatively small, yet hand repair of solder joints is virtually eliminated. As a result, better radiator cores are produced in shorter periods of time and at less cost than by prior art methods.

Other aspects, object and advantages of this invention can be obtained from a study of the drawings, disclosure and the appended claims.

I claim:

1. A method of forming a structure (10) having at least one tube (12) which has a first pair (20, 22) of opposite sides and second pair (24, 26) of opposite sides connecting together the first pair (20,22) of opposite sides and having a plurality of fins (14) having holes (28) having a first pair (30,32) of opposite edges connected together by a second pair (34,36) of opposite edges, the tube (12) fitting in and being soldered to said fins (14) at said holes (28), comprising:

fitting said tube (12) in said holes (28) with a gap (42 or 44) between at least one of said first pair (20,22) of sides and the adjacent edge (30 or 32) of said holes (28) associated with said one of said first pair (20,22) of sides, said second pair (24,26) of opposite sides abutting against said second pair (34,36) of opposite edges;

positioning a source (38) of solder having a generally matching hole (40) to those in said fins (14) above an upper one of a selected pair of adjacent fins (14) and with said matching hole (40) about said tube (12), a space intermediate said selected pair being free of any solder source;

aligning said tube (12) with said solder source (38) generally vertically above said fins (14) to form a precore assembly (50); and heating said aligned assembly (50) sufficiently to liquify said solder source (38) and form a solder connection of said tube (12) to at least said selected pair of said fins (14) below said source (38) at said holes (28), said solder source (38) when liquified flowing through and filling said gap (42 or 44) associated with at least said selected pair of said fins (14) below said source (38), said solder of said source (38) subsequently hardening in said gap (42 or 44) associated with at least said selected pair of said fins (14) below said source 38 to form solder connections.

2. The method as in claim 1, including:

bending a portion of said fins (14) adjacent the edge (30 or 32) of said holes (28) towards a bottom end (18) of said tube (12).

3. The method as in claim 2, wherein said bending step is performed prior to said fitting step and wherein said fitting step is inserting said holes (28) over said tube (12) with the bent edge (30 or 32) aimed in a direction opposite to the relative direction of movement of the tube (12) and fins (14).

4. The method as in claim 1, wherein there are a plurality of said tubes (12) and a plurality of said solder sources (38) between a plurality of said fins (14).

5. The method as in claim 1, wherein said solder source (38) is a sheet (30) of said solder.

6. The method as in claim 1, including:

spraying the precore assembly (50) with flux prior to the heating step.

7. A method as in claim 1, wherein said tube (12) is fitted in said holes (28) to form a pair (42, 44) of said gaps between said first pair (20, 22) of sides and said first pair (30, 32) of edges.

8. A method as in claim 4, wherein said solder sources (38) are separated by more than one of said fins (14).

9. A method of forming a structure (10) having at least one tube (12) which has a first pair (20, 22) of opposite sides and a second pair (24, 26) of opposite sides connecting together the first pair (20, 22) of sides and having a plurality of fins (14) having holes (28) having a first pair (30, 32) of opposite edges connected together by a second pair (34, 36) of opposite edges, the tube (12) fitting in and being soldered to said fins (14) at said hole (28), comprising:

fitting said tube (12) in said holes (28) with a pair of gaps (42, 44), said gaps being between said first pair (20, 22) of sides and the adjacent edges (30, 32) of said holes (28), said holes (28) having a slightly smaller dimension between said second pair (34, 36) of edges than the dimension between the furthest separated portions of said second pair (24, 26) of sides and having substantially the same dimension between said first pair (30, 32) of edges as between said first pair (20, 22) of sides and wherein said fitting step is force fitting which causes said first pair (20, 22) of sides to bulge slightly inwardly and provide said pair (42, 44) of said gaps;

positioning a source (38) of solder having a generally matching hole (40) to those in said fins (14) adjacent one of said fins (14) and with said matching hole (40) about said tube (12);

aligning said tube (12) with said solder source (38) generally vertically above said fins (14) to form a precore assembly (50); and heating said aligned assembly (50) sufficiently to liquify said solder source (38) and form a solder connection of said tube (12) to more than one of said fins (14) below said source (38) at said holes (28).

10. An assembly (50) formed into a heat exchanger core (10) via bulk heating treatment thereof, comprising:

a plurality of tubes (12), each having a first pair (20,22) of opposite sides and a second pair (24,26) of opposite sides connecting together said first pair (20,22) of sides;

a plurality of generally parallel fins (14) each having a plurality of holes (28) having a first pair (30,32) of opposite edges and a second pair (34,36) of opposite edges connecting together said first pair (30,32) of edges, said fins (14) being mounted at said holes (28) generally orthogonally to said tubes (12) with a gap (42 or 44) between at least one of the first pair (20,22) of sides and at least one of said first pair (30,32) of edges, said second pair (24,26) of opposite sides abutting against said second pair (34,36) of opposite edges; and a plurality of sources (38) of solder, each having a plurality of holes (40) generally matching holes in said fins (14), said sources (38) being mounted at said matching holes (40) to said tubes (12) between said fins (14), at least two fins (14) being disposed intermediate each of said sources (38) of solder.

11. The assembly as in claim 10, wherein said first pair (20,22) of edges of said holes (28) in said fins (14) are bent towards one end (18) of said tube (12).

12. The assembly as in claim 10, wherein there are a pair (42, 44) of said gaps between said first pair (20, 22) of sides and said first pair (30, 32) of edges.

13. The assembly as in claim 10, wherein said solder sources (38) are separated by more than one of said fins (14).

14. An assembly (50) formed into a heat exchanger core (10) via bulk heating treatment thereof, comprising:

a plurality of tubes (12) each having a first pair (20, 22) of opposite sides and a second pair (24, 26) of opposite sides connecting together said first pair (20, 22) of sides;

a plurality of generally parallel fins (14) each having a plurality of holes (28) having a first pair (30, 32) of opposite edges and a second pair (34, 36) of opposite edges connecting together said first pair (30, 32) of edges, said fins (14) being mounted at said holes (28) generally orthogonally to said tubes (12) with a pair (42, 44) of gaps between at least one of said first pair (20, 22) of sides and at least one of said first pair (30, 32) of edges, said second pair (24, 26) of sides being force fit against said second pair (34, 36) of edges and said first pair (20, 22) of sides bulging inwardly and defining said pair (42, 44) of said gaps; and a plurality of sources (38) of solder, each having a plurality of holes (40) generally matching those in said fins (14), said sources (38) being mounted at said matching holes (40) to said tubes (12) between said fins (14).

* * * * *